US011358255B2

(12) United States Patent
Taylor et al.

(10) Patent No.: US 11,358,255 B2
(45) Date of Patent: Jun. 14, 2022

(54) MACHINE VISE ANTI-LIFT JAWS

(71) Applicant: FIFTH AXIS, INC., San Diego, CA (US)

(72) Inventors: Chris Taylor, San Diego, CA (US); Stephen Grangetto, San Diego, CA (US); Adam Lane, San Diego, CA (US)

( * ) Notice: Subject to any disclaimer, the term of this patent is extended or adjusted under 35 U.S.C. 154(b) by 274 days.

(21) Appl. No.: 16/595,720

(22) Filed: Oct. 8, 2019

(65) Prior Publication Data

US 2020/0282520 A1 Sep. 10, 2020

Related U.S. Application Data

(60) Provisional application No. 62/728,854, filed on Sep. 9, 2018.

(51) Int. Cl.
*B25B 1/24* (2006.01)
*B25B 1/10* (2006.01)

(52) U.S. Cl.
CPC ..... *B25B 1/2473* (2013.01); *B25B 1/103* (2013.01); *B25B 1/241* (2013.01); *B25B 1/2452* (2013.01); *B25B 1/2463* (2013.01)

(58) Field of Classification Search
CPC ..... B25B 1/2473; B25B 1/103; B25B 1/2463; B25B 1/241; B25B 1/2457; B25B 1/2452; B25B 1/24; B25B 1/2405; B25B 1/2478
USPC ..... 269/138, 242, 95, 136, 256, 43
See application file for complete search history.

(56) References Cited

U.S. PATENT DOCUMENTS 1,379,747 A * 5/1921 Cumner ..... B25B 1/125 269/85
1,406,981 A * 2/1922 Cumner ..... B25B 1/103 269/138
1,457,307 A * 6/1923 Kerns ..... B25B 1/2473 269/138
2,564,138 A * 8/1951 Walker ..... B25B 1/24 269/138
3,514,092 A 5/1970 Lassy
3,603,605 A 9/1971 Webster, Jr.
5,163,662 A 11/1992 Bernstein
5,649,694 A 7/1997 Buck

* cited by examiner

*Primary Examiner* — Mahdi H Nejad
(74) *Attorney, Agent, or Firm* — Mark Wisnosky

(57) ABSTRACT

A machine-tool vise is described that employs an articulated two-piece movable jaw including a jaw nut that engages the lead screw and a jaw bit coupled to the jaw nut through a slanted interface wherein the slanted interface between the nut and the bit is located at the top of the bit to eliminate the secondary effects found in the prior art.

2 Claims, 6 Drawing Sheets

MACHINE VISE ANTI-LIFT JAWS

CROSS-REFERENCE TO RELATED APPLICATIONS

This application claims priority to U.S. Provisional application 62/728,854, titled Machine Vise Anti-Lift Jaws, by the same inventors.

BACKGROUND OF THE INVENTION

Technical Field

The present invention relates to improvements in machine-tool vises and in particular to the problem of holding the work more securely and locating it more accurately in the vise.

Related Background Art

In a conventional machine-tool vise there is a tendency for the movable jaw to rise and tilt away from the workpiece as clamping pressure is increased. In addition to decreasing the ability of the jaws to firmly grip the workpiece, this causes the location of the workpiece in the vise to be uncertain and difficult to reproduce with precision. This can be problematic when working on complex workpieces that must be switched among different machine tools during fabrication.

A number of prior attempts at solving this problem have involved an articulated, two-part movable jaw. One part is referred to as the jaw "nut" which is threaded to accept a lead screw. The other part is coupled to the jaw "nut" and engages the workpiece and is referred to as a jaw "bit." The two parts are coupled through a slanted interface that is arranged so that lateral translation of the nut causes both a lateral translation of the bit to grasp the workpiece and a downward vertical translation of the bit to press the workpiece against the base of the vise to overcome the lifting of the nut.

These prior attempts have been partially successful in reducing the lifting of the workpiece as the vise is tightened and the slanted interface is typically located below the jaw bit to make the solution more compact. However, we have found that this configuration gives rise to secondary effects in certain common clamping configurations that result in undesired deflection and lifting of the workpiece.

DISCLOSURE OF THE INVENTION

A machine-tool vise is described that employs an articulated two-piece movable jaw including a jaw nut that engages the lead screw and a jaw bit coupled to the jaw nut through a slanted interface wherein the slanted interface between the nut and the bit is located at the top of the bit to eliminate the secondary effects found in the prior art.

BRIEF DESCRIPTION OF THE DRAWINGS

Features are numbered equivalently through all drawings.

MODES FOR CARRYING OUT THE INVENTION

Figure 1A:
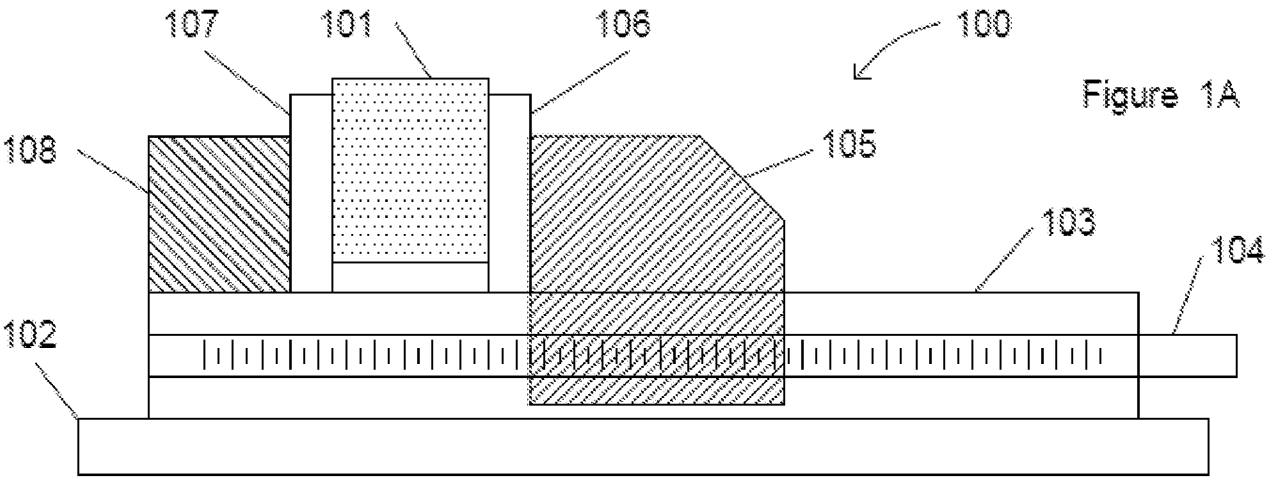
Prior Art Figure 1A
FIG. 1A is a drawing of a conventional machine-tool vise illustrating the jaw-lift problem.
Figure 1B:
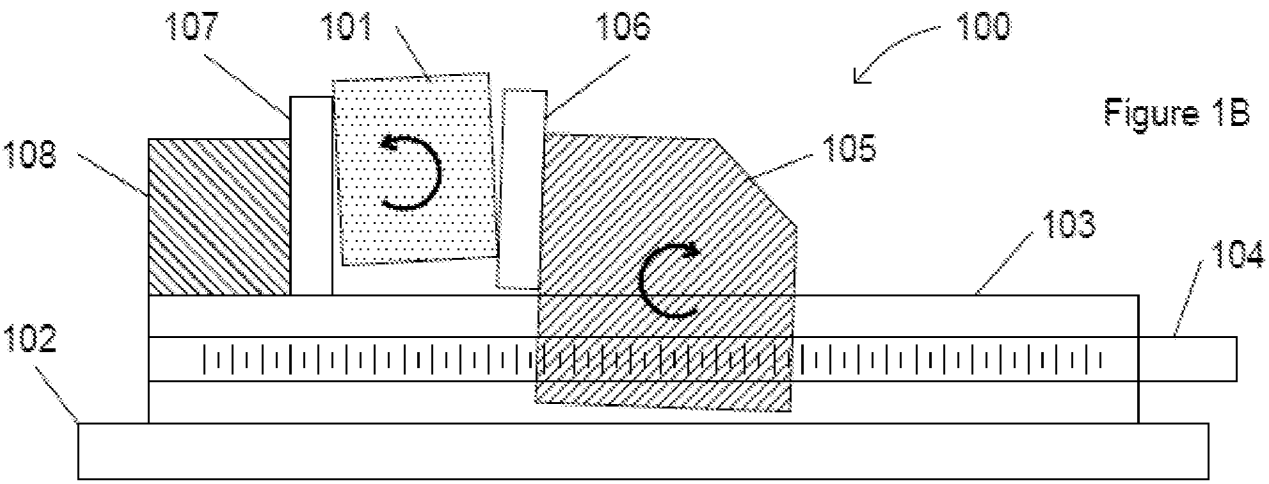
FIG. 1B shows the vise 100 of FIG. 1A in which the lead screw has been further advanced.

FIG. 1A shows a conventional machine-tool vise 100 clamping a workpiece 101. The simple vise comprises a base 102 for attaching the machine-tool vise 100 to a machine-tool and body 103, the latter containing a lead screw 104 mounted in appropriate bearings machined into the body (not shown) that advances a movable jaw 105 threaded onto the lead screw and to which a jaw plate 106 is attached towards a fixed jaw 107 having jaw plate 108. FIG. 1B shows the vise 100 of FIG. 1A in which the lead screw 104 has been further advanced to apply additional pressure to the workpiece 101. Owing to nominal machining tolerances or to wear in the lead screw 104 and/or the threaded hole in the movable jaw 105, the additional pressure causes the movable jaw 105 with attached jaw plate 106 to rock away from the workpiece 101 thereby lifting the face 110 of the workpiece 101 adjacent to the movable jaw plate 106 away from the body 103 resulting in an undesirable and irreproducible change in the position and orientation of the workpiece 101.

Figure 2:
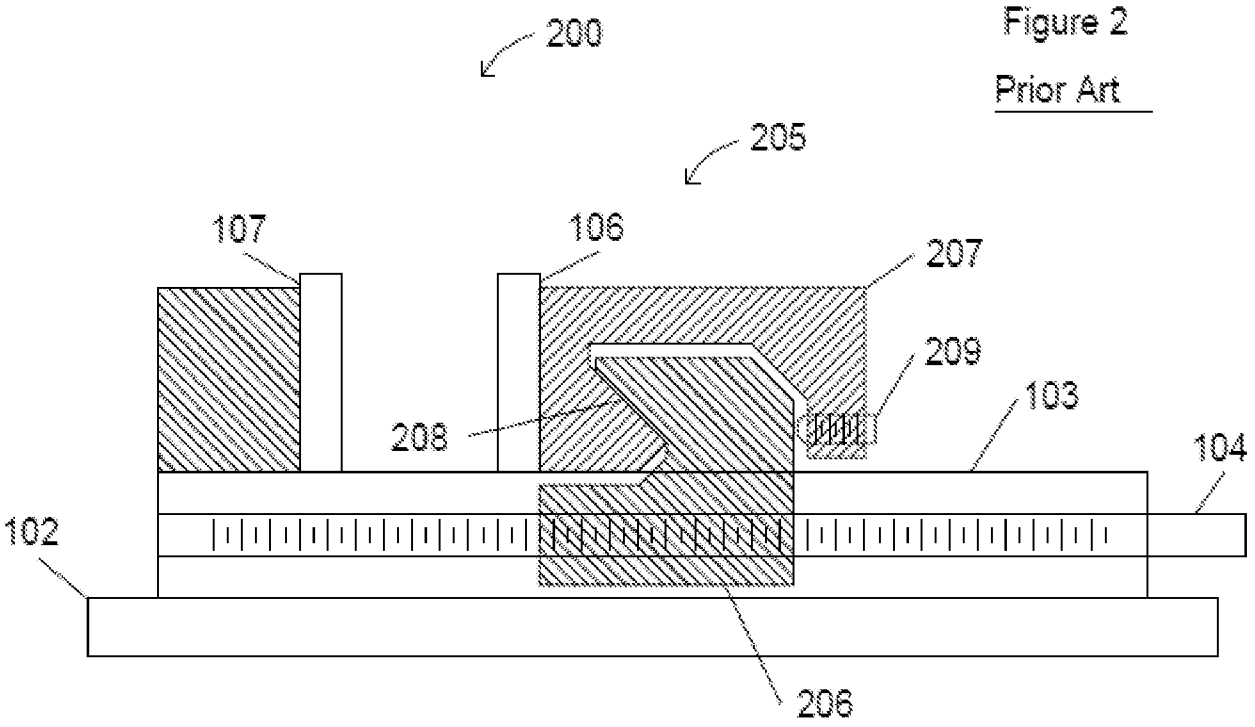
Figure 2 Prior Art
FIG. 2 is a drawing of the prior art improved vise.

FIG. 2 shows a simplified diagram of a prior art machine-tool vise 200 designed to overcome the jaw-lift problem illustrated in FIG. 1B. Articulated movable jaw 205 comprises jaw nut 206 threaded to accept lead screw 104 which couples to jaw bit 207 having jaw plate 106 at slanted interface 208. Set screw 209 is snugged against jaw nut 206 to stabilize the movable jaw assembly 205.

Figure 3A:
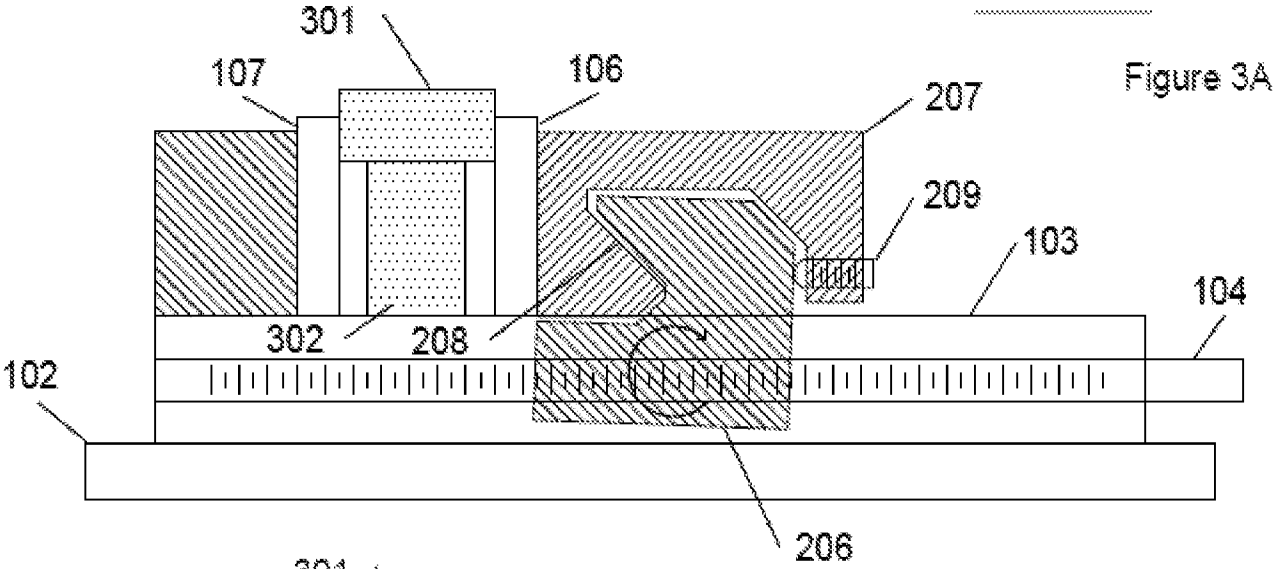
Prior Art Figure 3A
FIG. 3A is a drawing illustrating the jaw-lift problem with the prior art vise when clamping thin workpieces.

FIG. 3A shows the prior art vise 200 of FIG. 2 when clamping a thin workpiece 301. Normal machining practice calls for the use of a spacer tool 302 having parallel top and bottom surfaces between workpiece 301 and vise body 103. The figure illustrates the case shown in FIG. 1B in which lead screw 104 has been advanced to increase clamping pressure on workpiece 301 resulting in jaw nut 206 rocking away from workpiece 301. The jaw nut 206 and jaw bit 207 remain in contact at the slanted interface 208 and the spacing between jaw nut 206 and jaw bit 207 allows jaw nut 206 to move slightly without altering the position of jaw bit 207. This configuration results in moderate clamping pressure applied to the workpiece 301 with no appreciable jaw lifting of the jaw bit 207 and jaw plate 106. However, further increase in clamping pressure by attempting to advance lead screw 104 can result in the configuration shown in FIG. 3B in which the force applied to jaw bit 207 causes it to rock away from the workpiece 301, resulting in the positional misalignment of workpiece 301 similar to that shown in FIG. 1B.

Figure 3B:
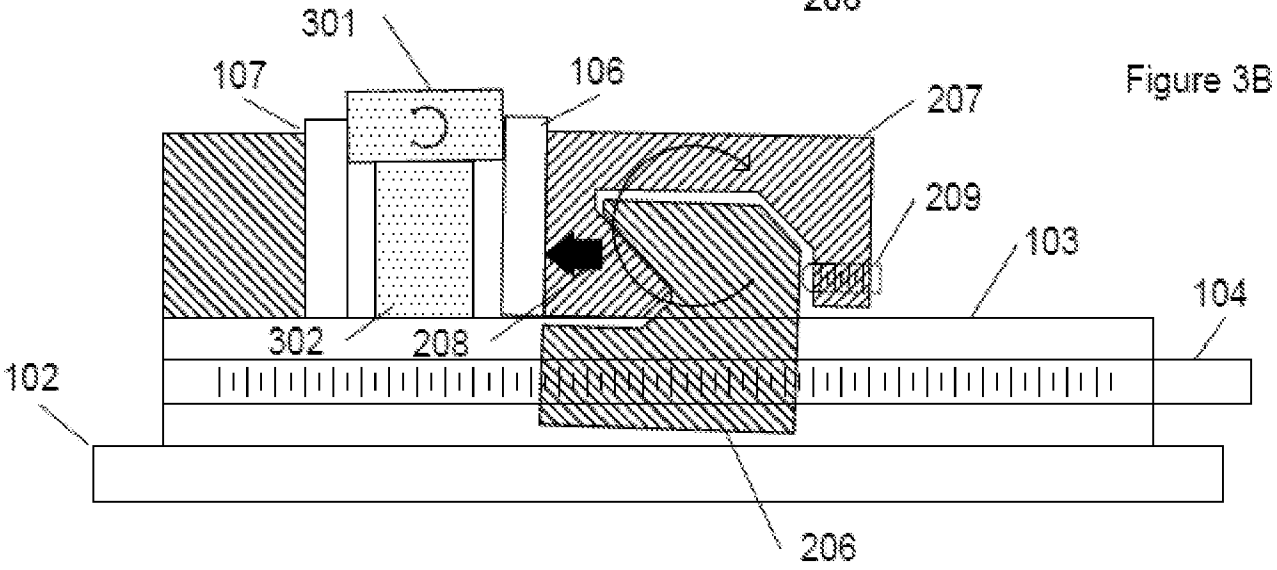
FIG. 3B shows positional misalignment of a workpiece with the prior art vise.
Figure 4:
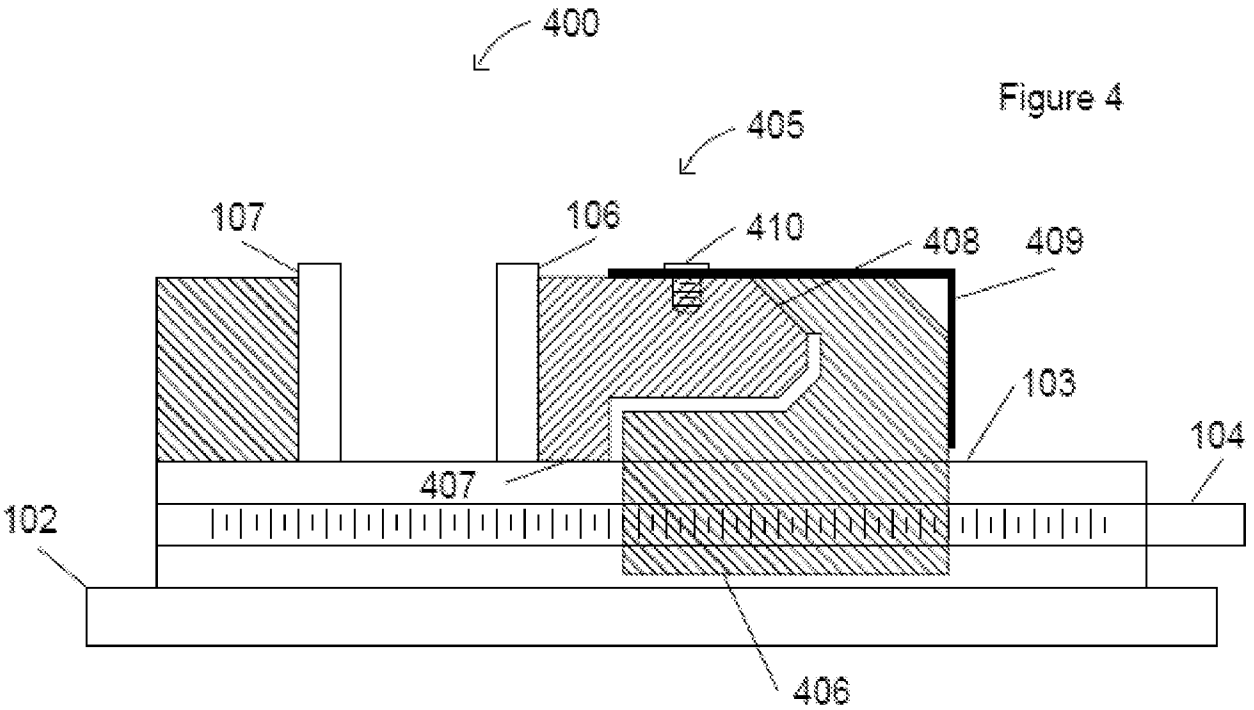
FIG. 4 is a drawing of one embodiment of the new vise.

FIG. 4 shows a simplified diagram of an embodiment of new machine-tool vise 400 designed to overcome the jaw-lift problem illustrated in FIG. 3B. Articulated movable jaw 405 comprises jaw nut 406 threaded to accept lead screw 104 which couples to jaw bit 407 having jaw plate 106 at slanted interface 408 now located at the top of jaw bit 407. The movable jaw assembly is stabilized using bracket 409 which is affixed 410 only to the jaw bit 407.

Figure 5:
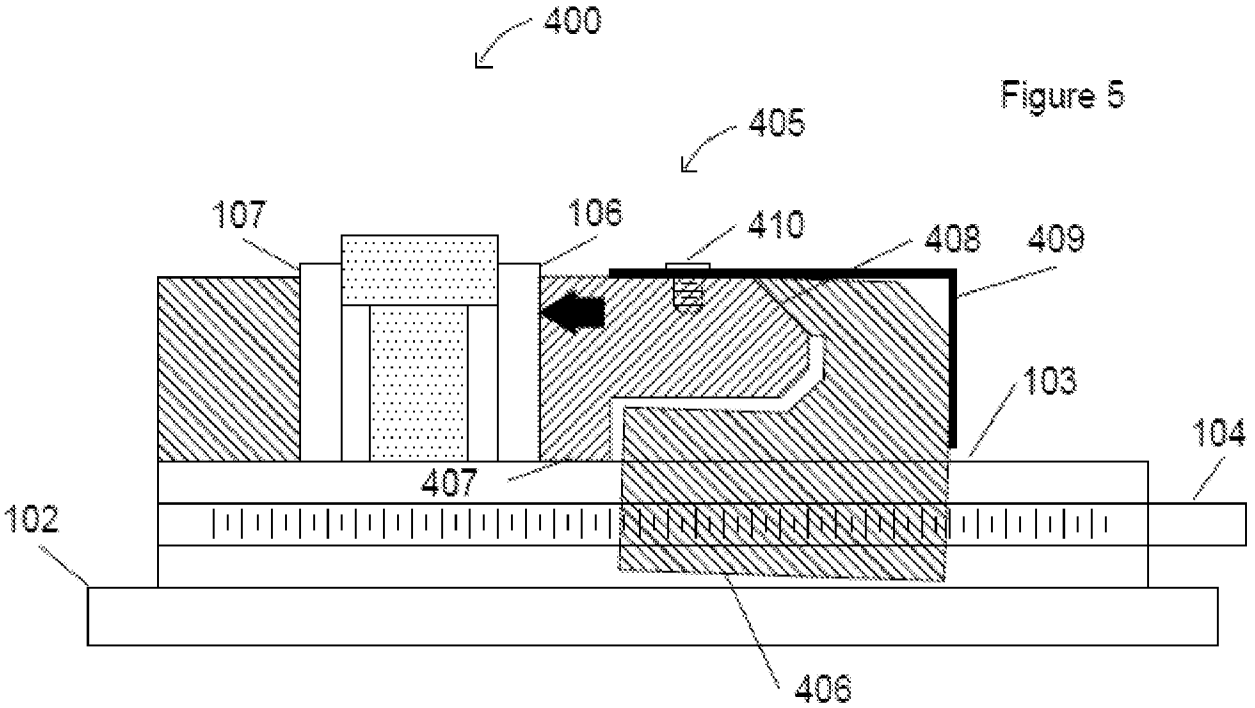
FIG. 5 is a drawing showing the clamping of thin workpieces without jaw-lift using the new vise.

FIG. 5 shows the new vise 400 of FIG. 4 when clamping a thin workpiece 301. Normal machining practice calls for the use of a spacer tool 302 having parallel top and bottom surfaces between workpiece 301 and vise body 103. The figure illustrates the case shown in FIG. 3A in which lead screw 104 has been advanced to increase clamping pressure on workpiece 301 resulting in jaw nut 206 rocking away from workpiece 301. The jaw nut 406 and jaw bit 407 remain in contact at the slanted interface 408 and the spacing between jaw nut 406 and jaw bit 407 allows jaw nut 406 to move slightly, sliding within bracket 409 without altering the position of jaw bit 407. This configuration results in moderate clamping pressure applied to the workpiece 301 with no appreciable jaw lifting of the jaw bit 407 and jaw plate 106. Further increase in clamping pressure by attempting to advance lead screw 104 results in negligible displacement of the workpiece 301 compared to the configuration shown in FIG. 3B since the additional force applied to jaw bit 407 remains applied primarily at the interface between the workpiece 301 and the jaw plate 106.

Figure 6:
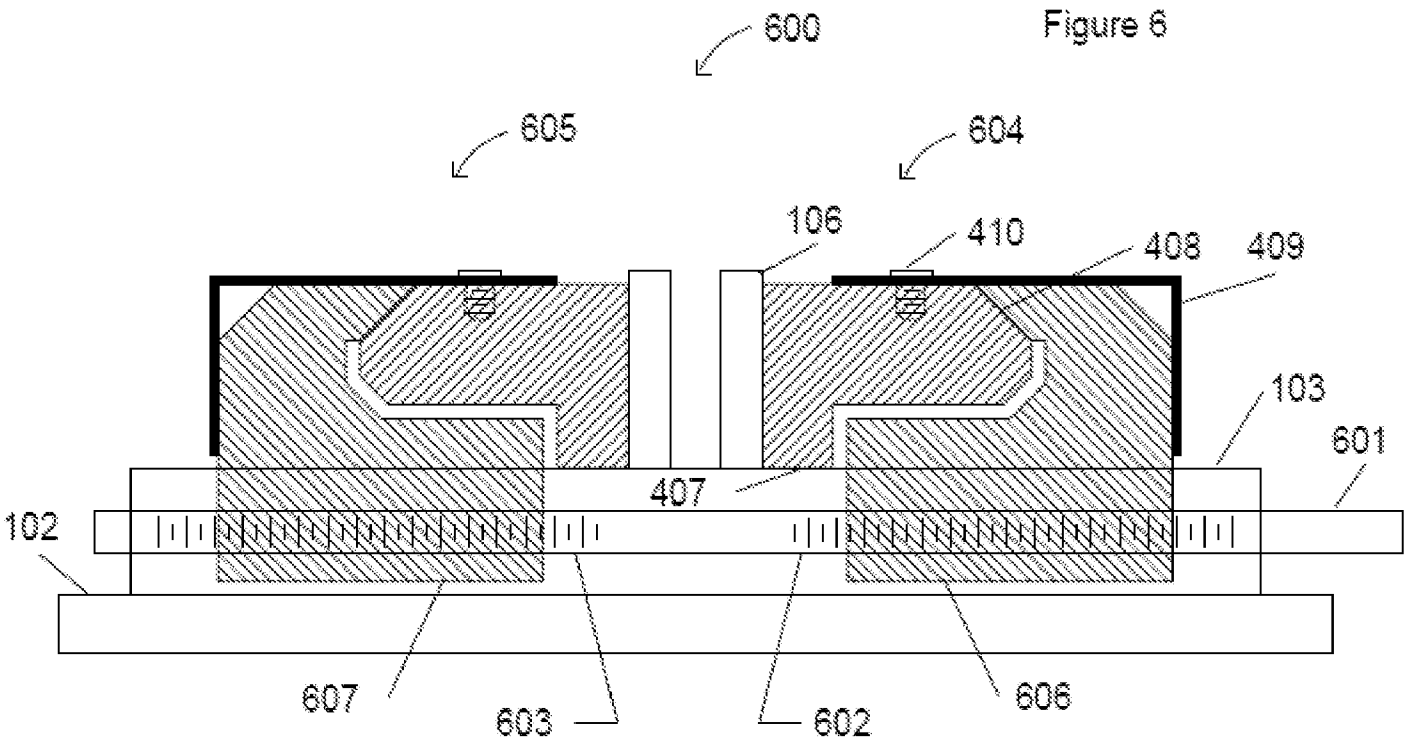
FIG. 6 is a drawing showing an embodiment of the new vise having two movable jaws.

FIG. 6 shows the configuration of an embodiment 600 of the new vise having two movable jaws 604 and 605. Movable jaw 604 is of the same configuration as shown in FIG. 4 wherein jaw nut 606 is right-hand threaded. Movable jaw 605 is the same as movable jaw 604 except that jaw nut 607 is left-hand threaded. Lead screw 601 is configured to have right-hand threads at one end 602 and left-hand threads at the other end 603 to draw the movable jaws 405 together or move them apart by rotating the lead screw 601.

SUMMARY

A machine-tool vise is described that employs an articulated two-piece movable jaw including a jaw nut that engages the lead screw and a jaw bit coupled to the jaw nut through a slanted interface wherein the slanted interface between the nut and the bit is located at the top of the bit to eliminate the secondary effects found in the prior art.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A machine vise comprising:

a) a base (102), b) a machined body (103) affixed to said base, c) a stationary jaw (107) affixed to said machined body, d) an articulated movable jaw (405) comprising:

i) a jaw nut (406) threaded to accept a lead screw (104), and, ii) a jaw bit (407) attached to a jaw plate (106), and, iii) the jaw nut and the jaw bit having similar slanted surfaces (408) wherein the slanted surface on the jaw bit is machined extending to a top surface of the jaw bit and the slanted surface of the jaw nut is machined into an underside of an extension of the jaw nut and extending to a top surface of the jaw nut, and, iv) an L-shaped bracket (409) affixed (410) only to the top surface of the jaw bit, engaging the top surface of the jaw nut and enclosing the extension of the jaw nut (406), and, e) once a workpiece is clamped between the articulated movable jaw (405) and the stationary jaw (107) and the lead screw is advanced to increase a clamping pressure on the workpiece, the jaw nut and the jaw bit remain in contact at the similar slanted surfaces and a spacing between the jaw nut and the jaw bit allows the jaw nut to move slightly, sliding within the L-shaped bracket without altering a position of the jaw bit 407, and a further increase in the clamping pressure by attempting to advance the lead screw results in negligible displacement of the workpiece.

2. A machine vise comprising:

a) a base (102), b) a machined body (103) affixed to said base, c) a first articulated movable jaw (604) and a second articulated movable jaw both attached to the machined body and each comprising:

i) jaw nuts (606, 607) threaded to accept a lead screw (601), and, ii) jaw bits (407) attached to a jaw plate (106), and, iii) the jaw nuts and the jaw bits each having similar slanted surfaces (408) wherein the slanted surfaces on each of the jaw bits is machined extending to top surfaces of each of the jaw bits and the slanted surfaces of each of the jaw nuts is machined into an underside of extensions on each of the jaw nuts and extending to top surfaces of each of the jaw nuts, and, iv) L-shaped brackets (409) affixed (410) only to the top surfaces of each of the jaw bits, engaging the top surfaces of each of the jaw nuts and enclosing extensions of each of the jaw nuts, and, v) once a workpiece is clamped between the first articulated movable jaw (604) and the second articulated movable jaw (605) and the lead screw is advanced to increase a clamping pressure on the workpiece each of the jaw nuts and the jaw bits remain in contact at the similar slanted surfaces and a spacing between the jaw nuts and the jaw bits allow each of the jaw nuts to move slightly, sliding within the L-shaped brackets without altering a position of the jaw bits, and further increase in the clamping pressure by attempting to advance the lead screw results in negligible displacement of the workpiece.

* * * * *